United States Patent [19]

Peeters-Weem

[11] Patent Number: 4,598,751

[45] Date of Patent: Jul. 8, 1986

[54] FOLDING WALL

[75] Inventor: Petrus J. Peeters-Weem, Oosterhout, Netherlands

[73] Assignee: 501 Pella B. V. Pannigen, Netherlands

[21] Appl. No.: 665,080

[22] PCT Filed: Apr. 14, 1981

[86] PCT No.: PCT/NL81/00011

§ 371 Date: Dec. 4, 1981

§ 102(e) Date: Dec. 4, 1981

[87] PCT Pub. No.: WO81/03043

PCT Pub. Date: Oct. 29, 1981

Related U.S. Application Data

[63] Continuation of Ser. No. 542,091, Oct. 17, 1983, abandoned, which is a continuation of Ser. No. 328,584, filed as PCT NL81/00011, on Apr. 14, 1981, published as WO81/03043, on Oct. 29, 1981, abandoned.

[30] Foreign Application Priority Data

Apr. 15, 1980 [NL] Netherlands ..... 8002187

[51] Int. Cl.[4] ..... E06B 3/94

[52] U.S. Cl. ..... 160/84 R

[58] Field of Search ..... 160/84 R

[56] References Cited

U.S. PATENT DOCUMENTS

| | | | |
|---|---|---|---|
| 3,029,867 | 4/1962 | Maurer | 160/84 H |
| 3,979,861 | 9/1976 | Fromme | 160/199 X |
| 4,199,018 | 4/1980 | Hirschel | 160/84 R |

FOREIGN PATENT DOCUMENTS

| | | | |
|---|---|---|---|
| 68687 | 2/1949 | Denmark | 160/84 |
| 93592 | 8/1962 | Denmark | 160/84 R |
| 1683185 | 10/1969 | Fed. Rep. of Germany | 160/84 X |
| 2506469 | 8/1975 | Fed. Rep. of Germany | 160/84 R |
| 2559443 | 11/1976 | Fed. Rep. of Germany | 160/84 R |
| 1099509 | 3/1955 | France . | |
| 2229844 | 5/1974 | France . | |

*Primary Examiner*—Ramon S. Britts
*Assistant Examiner*—Cherney S. Lieberman
*Attorney, Agent, or Firm*—John P. Snyder

[57] ABSTRACT

A folding wall being composed of modules and substantially comprising a double row of panels foldable in zigzag fashion by means of hinges, wherein at least two panels being in opposite positions in the rows are pivotally interconnected by a coupling piece having two relatively spaced supporting members, while two blades of resilient material slidable between two supporting members are each fastened to an inner side of a panel, said resilient blades will cause an inwardly directed force upon the panels when the wall is drawn out, so moving these panels into a parallel position, and wherein a lever is connected at a distance from the supporting members by means of a hinge with the coupling piece, so when folding the wall, said lever is adapted to exert a pressure on the free ends of the resilient blades, causing an outwardly directed force upon the associated panels so that the zigzag folding of the wall is facilitated.

21 Claims, 5 Drawing Figures

FOLDING WALL

Figure 1:
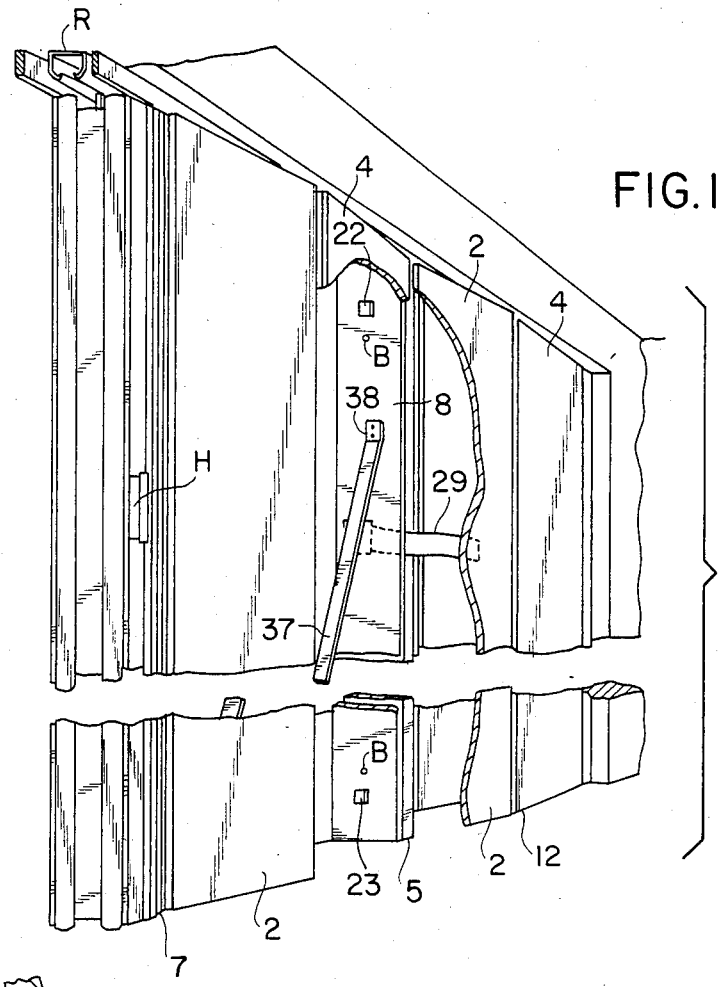

This application is a continuation of application Ser. No. 542,091, filed Oct. 17, 1983, abandoned, which is a Rule 1.62 cont. of Ser. No. 328,584 filed as PCT NL 81/00011, on Apr. 14, 1981, published as WO81/03043, on Oct. 29, 1981, abandoned.

The invention relates to a folding wall mainly comprising a double row of panels foldable in zigzag fashion by means of hinges.

The invention has for its object to improve the folding wall in a manner such that in the stretched state the panels lie in co-planar positions with the aid of simple means which, at the same time, facilitate folding of the wall. The invention has furthermore for its object to provide a folding wall which reduces transport and mounting costs by its modular structure.

The folding wall according to the invention is distinguished in that at least two panels being in opposite positions in the rows are pivotally interconnected by a coupling piece having two relatively spaced supporting members, whilst two blades of resilient material slidable between two supporting members are each fastened to an inner side of a panel.

Owing to the resilient blades the panels connected with said blades will be subjected to an inwardly directed force when the wall is drawn out, so that these panels can be moved into parallel positions. By means of the pivotal connection with the further panels, the latter will follow said movement, and move to the same plane.

According to the invention opening of the folding wall is facilitated because a lever is connected at a distance from the members by means of a hinge with the coupling piece. By actuating said lever, which exerts pressure on the free ends of the resilient blades, an outwardly directed force is exerted on the associated panels so that the zigzag folding of the wall is facilitated.

The proximal sides of the spring blades are preferably coated with a layer of rough material to avoid slip between the spring blades and to ensure uniform flattening of the panels.

According to the invention the folding wall of the kind set forth in the preamble is furthermore characterized in that every four panels and two head strips are combined to form a hollow module, the head strips being provided with means for fastening the strips to one another. Thus the mounting operation is drastically simplified, since every module is suspended to the guide rail required for the wall, after which only one operator need fasten the modules to one another. Since the modules are easily separated, transport is also simplified.

The coupling piece mentioned above is preferably formed by a head strip of a module.

In order to reduce the friction of the spring blades along the supporting members, the latter are formed by rollers arranged, in the modular structure of the wall, in two opposite sides of an opening in the head strips.

A simple construction and an effective sound-proof assembly are obtained in that inter alia the panels and head strips are interconnected at the longitudinal edges by uninterrupted hinge profiles of synthetic resin.

Figure 2:
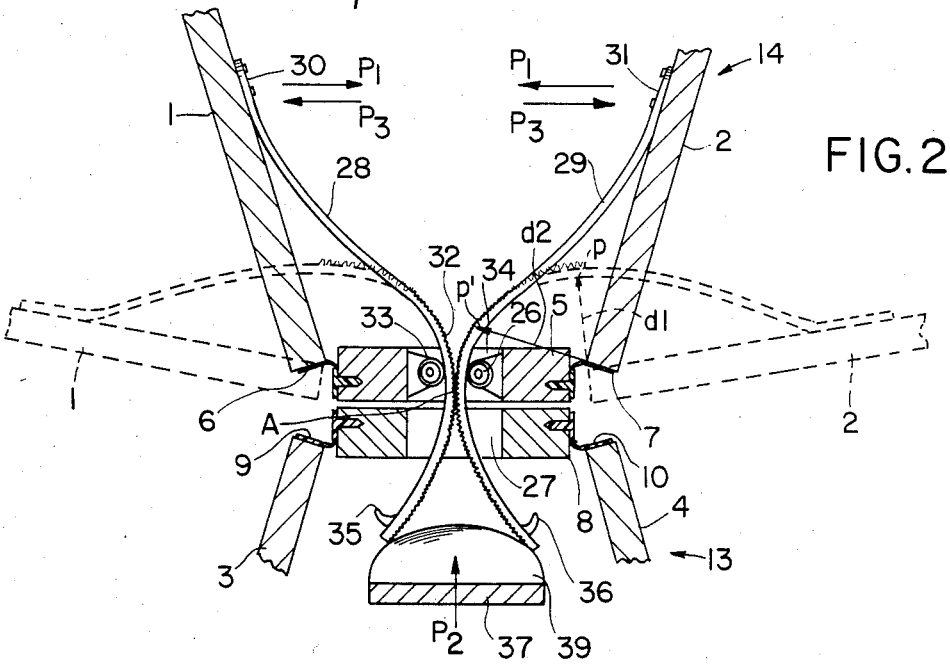
Figure 3:
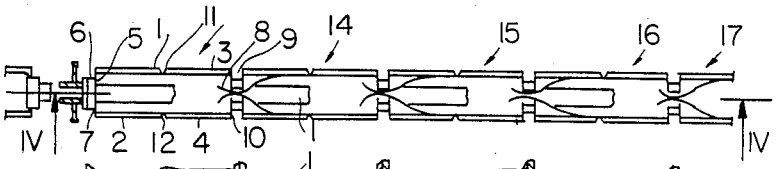
Figure 4:
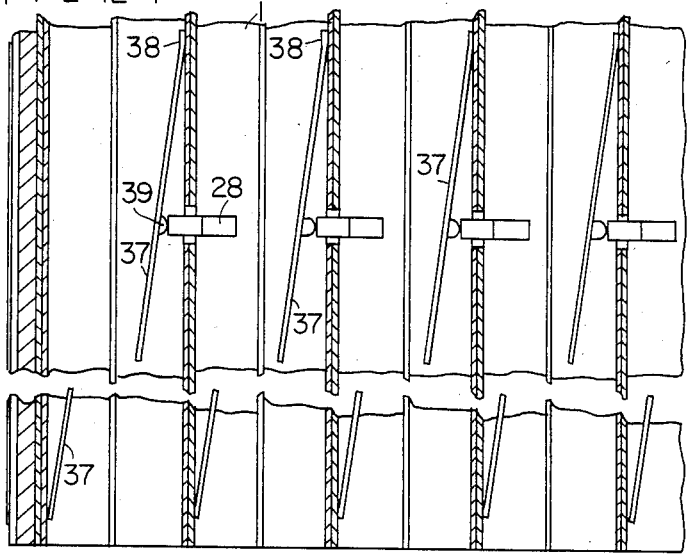
Figure 5:
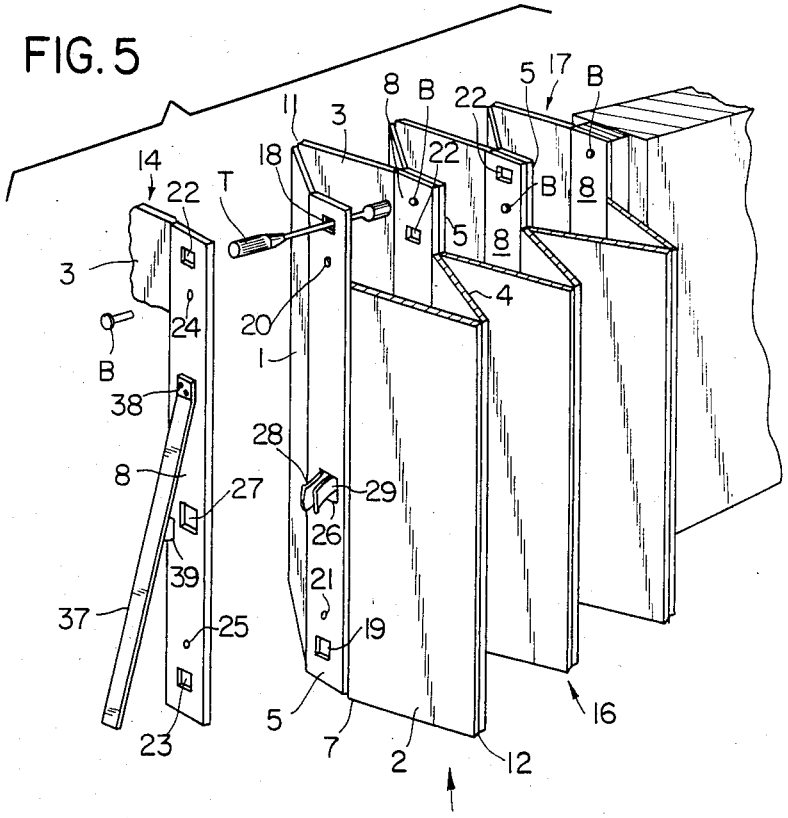

The invention will be described more fully with reference to an embodiment. The accompanying drawing shows in:

FIG. 1 a perspective view of part of the folding wall in accordance with the invention, FIG. 2 an enlarged sectional detail of the wall of FIG. 1, FIG. 3 a horizontal sectional view of part of the folding wall in the stretched position, FIG. 4 a vertical sectional view of the folding wall of FIG. 3, FIG. 5 a perspective view of part of the folding wall illustrating the mounting operation.

The folding wall shown in the Figures is suspended from the overhead rail R and is composed of a plurality of modules each consisting of two pairs of relatively pivotable panels. Thus, as shown in FIG. 3, one pair of panels for each module is designated by the reference characters 1 and 2 whereas the other pair of panels for each module is designated as 3 and 4. The panels 1 and 2 are pivotally connected by respective hinge means 6 and 7 to the opposite side edges of coupling means comprising the head strip or coupling member 5 whereas the panels 3 and 4 are pivotally connected to the opposite side edges of the coupling means 8 by respective hinge means 9 and 10. The two panels 1 and 3 and the two panels 2 and 4 of each module are likewise pivotally connected at their adjacent side edges by the hinge means 11 and 12. All of these hinge means are in the form of strips of synthetic resin material (see particularly FIG. 2). This structure relates to one module 13 as shown in FIG. 3 and the remainder of the modules 14–17 shown are of the same configuration, and for this resaon, the same reference characters are employed in each module throughout the drawings to designate like components. Each module is suspended by a runner system fastened to the top side of each coupling member from the overhead rail R which extends along the top edge of a passage between two rooms.

FIG. 5 illustrates the manner in which the modules are interconnected. As shown, each of the coupling members 5 is provided with a pair of rectangular openings 18 and 19 through which a tool T may be projected to reach to the associated coupling member 8 of that module. Likewise, each of the coupling members 5 is provided with a pair of tapped openings 20 and 21. The coupling member 8 for each module, on the other hand, is provided with a pair of rectangular openings 22 and 23 which register with the rectangular openings 18 and 19 of the associated coupling member 5 of the adjacent module with which it is in face-to-face contact and is also provided with openings 24 and 25 in register with the tapped openings 20 and 21 in such associated coupling member 5 so as to receive bolts B threaded in the respective tapped openings 20 and 21 to secure the associated coupling members 5 and 8 of the adjacent modules in face-to-face contact as shown.

The coupling members 5 and 8 are also provided with registering openings 26 and 27 (see also FIG. 2) through which the free end portions of a pair of blade springs or spring strips 28 and 29 are received. As is seen best in FIG. 2, the opposite ends of these spring strips are secured at 30 and 31 to the inner faces of the respective panels 1 and 2. The spring blades 28 and 29 are provided on their proximal sides with a coating of rough material 32, which may have a ridge profile, in order to avoid slip between the spring blades. Each coupling member 5 is provided with a pair of rollers 33 and 34 within its opening 26, the rollers defining a gap which allows the spring strips to engage at a contact point or region A. The spring blades are provided near the free ends thereof with the ears 35 and 36 which prevent the free ends of the strips from escaping from between the rollers when the modules are in collapsed condition.

It will be noted that a lever 37 is hinged at one end as at 38 to the inner face of each coupling member 8 through which a pair of spring strips 28 and 29 project. This lever extends diagonally downwardly as seen best in FIGS. 1, 4 and 5 to the inner face of the coupling member 5 of that module when such module is expanded as shown in these Figures. Between its ends and in alignment with the openings 26 and 27, each such lever is provided with a bumper or pressing head 39 which is adapted to press against the free ends of the spring strips of an adjacent module. It will be noted that when the modules are in the collapsed condition, the two coupling members 5 and 8 of each module are closely spaced and will retain the pressing head 39 of the associated lever 37 against the free ends of the spring strips 28 and 29 of the adjacent module. It should also be noted that the leading module (i.e., the module 13 of FIG. 4) does not have spring strips 28 and 29 associated with it. Therefore, the only structure which is operating to hold this particular module in expanded condition is its associated lever 37 and the ends of the spring strips 28 and 29 of the adjacent module 14 bearing against the pressing head 39 of such lever. It should further be noted that the trailing module such as the module 17 in FIG. 5 does not require a lever 37 although it has the spring strips 28 and 29 to control such module.

The folding wall of the invention can be actuated from a collapsed condition of the modules to an expanded condition of the modules by pulling on the handle H, see FIGS. 1 and 3. In the collapsed condition, the panels 1 and 2 of a module are in generally coplanar relation, as are the panels 3 and 4. Thus, the inner faces of the panels 1 and 3 are in closely spaced, face-to-face opposition whereas the inner faces of the panels 2 and 4 are likewise so positioned. In the expanded condition, the panels 1 and 3 of a module are generally coplanar, as are the panels 2 and 4. Thus, the inner faces of the panels 1 and 2 are generally parallel but spaced apart and the same is true for the inner faces of the panels 2 and 4. The expanded condition of the modules is shown in FIGS. 1, 3 and 4. The panels 1 and 2 as shown in dashed lines in FIG. 2 are near their positions in which the module is in collapsed condition whereas the solid line positions of these panels are near the expanded condition of the module.

FIG. 2 illustrates the geometry which leads to realization of the invention. One necessary condition is that the spring strips be compelled to move past the rollers as the panels are swung. That is, as a natural consequence of the attachment point 30 of the spring strip 28 to the inner face of the panel 1 swinging about the center of arc defined by the hinge means 6, the attachment point 31 of the spring strip 29 to the inner face of the panel 2 swinging about the center of arc defined by the hinge means 7, and the fact that the rollers 33 and 34 are between these hinge axes to define a gap receiving and guiding the movements of the spring strips, the spring strips 28 and 29 are compelled to move longitudinally back and forth between the rollers when the panels 1 and 2 fold relative to each other. The other necessary condition is that those portions of the spring strips which move past the rollers as aforesaid must have a shape which is flattened in the direction away from the rollers so as to converge to the contact point A. As a consequence, at an intermediate position of the panels as they are being inwardly swung, sufficient deformation of the spring blades has occurred and the contact point A between the spring blades has moved away from the rollers sufficient to exert forces on the panels urging them to the full inwardly swung positions.

The first necessary condition is evident from FIG. 2, as explained above. The shaping of the spring strips is also evident from FIG. 2. Thus, as shown in FIG. 2, the distance d1 from the axis of the hinge means 7 perpendicular to the face of the panel 2 to the point P on the associated spring blade 29 when the panel is in the dashed line position is smaller than the distance d2 from the axis of the hinge means 7 perpendicular to the face of the panel 2 to point P′ when the panel is in the full line position. Since the dashed line position of the panels 1 and 2 corresponds to that condition where the module is nearly fully collapsed whereas the full line position of the panels corresponds to the module approaching the expanded or inwardly swung position of the panels, it is evident that the aforesaid shaping of the spring blades 28 and 29 has caused them to be deformed as the panels 1 and 2 are swung from the dashed line position toward the full line position. It is also evident from FIG. 2 that the result of such shaping is that in both the dashed line position and the full line position of the panels, the two spring blades 28 and 29 are convergent from the rollers to the contact point A.

Thus, by drawing the folding wall from collapsed condition of the modules thereof toward expanded condition as by pulling on the handle H, the panels 1 and 2 and the panels 3 and 4 fold towards one another. Owing to these movements of the panels the spring strips are compelled to shift relative to the rollers as aforesaid so that they are deformed. The contact point A will shift away from the rollers, as controlled by the shape of the spring strips, so that in a semi-stretched or semi-expanded condition, the deformations cause inwardly directed forces to be exerted at the attachment points 30 and 31 in the direction of the arrows P1. These forces cause the modules to move to their expanded conditions.

In folding the wall to the collapsed condition of its modules, the levers 37 will be forced by the coupling members 5 to exert pressure by means of the pressing heads 39 on the free ends of the spring strips. This forces the spring strips to move in the direction P2 (forcing the contact point A toward the rollers) and acts through the attachments points 30 and 31 to produce the outwardly directed forces P3 so that the panels 1 and 2 are urged outwardly. As soon as the contact point A is forced to the side of attachment points 30 and 31 with respect to the rollers, a spring force generated in the spring strips by deformation will further the spread of the panels.

The invention is not limited to the embodiment described above. The flattening stretching by means of the resilient blades 28 and 29 may as well be used in another construction than that having the above-described module structure.

What is claimed is:

1. In a folding wall, a structure having first coupling means presenting a first side and a second side with spaced apart first and second edge portions, a first panel and first hinge means pivotally connecting said first panel to one edge portion of said first coupling means about a first axis, a second panel and second hinge means pivotally connecting said second panel to the other edge portion of said first coupling means about a second axis parallel to but spaced from said first axis, said first and second panels being swingable about the respective first and second axes between an inwardly swung position in which said panels present inner sides facing each other with said panels being in spaced parallelism and an outwardly swung position in which said panels are substantially coplanar, said first coupling means having an opening therethrough between said first and second sides thereof, a first spring blade attached to the inner side of said one panel at an attachment position on said first panel spaced from said one axis, a second spring blade attached to the inner side of said second panel at an attachment position on said second panel spaced from said second axis, said firt spring blade extending from said attachment position thereof through said opening in the first coupling means and said second spring blade extending from said attachment position thereof through said opening in the first coupling means, guide means carried by said first coupling member in straddling relation to said spring blades for defining a gap receiving and guiding said spring blades to move back and forth as said panels swing about their respective first and second axes, and said spring blades being shaped between their attachments to the respective first and second panels and said guide means such that said spring blades are flattened in the direction from said guide means toward said attachments along those portions of the spring blades which engage said guide means and are convergent as they enter said gap and engage each other at a contact point on the other side of said guide means from said panels when said panels have reached a partially inwardly swung position.

2. In a folding wall as defined in claim 1 including a third panel and hinge means pivotally connecting an edge of said thrid panel about a third axis to that edge of said first panel remote from said first axis, and a fourth panel and hinge means pivotally connecting an edge of said fourth panel about a fourth axis to that edge of said second panel remote from said second axis, second coupling means extending between the free edges of said third and fourth panels remote from said third and fourth axes respectively, hinge means pivotally connecting an edge of said second coupling means to a free edge of said third panel about a fifth axis and hinge means pivotally connecting an edge of said second coupling means to a free edge of said fourth panel about a sixth axis, all of said axes being parallel.

3. In a folding wall as defined in claim 2 wherein said second coupling means is provided with an opening aligned with the opening through said first coupling means and including a lever pivotally connected at one end to an inner face of said second coupling means and extending therefrom diagonally to terminate in an opposite end engaging said first side of said first coupling means, said lever having a pressing head secured thereto in alignment with said opening in the second coupling means.

4. In a folding wall as defined in claim 2 wherein said structure comprises a first discrete module, a second module identical to said first discrete module, a second coupling means of said second module being connected in opposing relation to said first coupling means of said first module and having an opening therethrough aligned with the opening through said first coupling means of said first discrete module, the ends of said first and second spring blades of said first discrete module passing through said opening in said second coupling means of said second module and terminating in spring blade ends within said second module, and a lever secured to that side of the second coupling means of said second module and angling away therefrom toward the opposing side of the first coupling means of said second module to terminate in an end portion adapted to be engaged by said opposing side of the first coupling means of said second module and having an intermediate portion aligned with said spring blade ends so that in response to relative movement of said first and second coupling means of said second module towards each other, said lever will bear against said spring blade ends to force said spring blades towards the interior of said first discrete module.

5. In a folding wall as defined in claim 1 wherein engaging portions of said spring blades are provided with means for preventing relative slippage therebetween.

6. In a folding wall as defined in claim 2 wherein engaging portions of said spring blades are provided with means for preventing relative slippage therebetween.

7. In a folding wall as defined in claim 3 wherein engaging portions of said spring blades are provided with means for preventing relative slippage therebetween.

8. In a folding wall as defined in claim 4 wherein engaging portions of said spring blades are provided with means for preventing relative slippage therebetween.

9. In a folding wall, a structure having first coupling means presenting a first side and a second side with spaced apart first and second edge portions, a first panel and first hinge means pivotally connecting said first panel to said first coupling means about a first axis, a second panel and second hinge means pivotally connecting said second panel to said first coupling means about a second axis parallel to but spaced from said first axis, said first and second panels being swingable about the respective first and second axes between an inwardly swung position and an outwardly swung position, said first coupling means having an opening therethrough between said first and second sides thereof, a first spring blade attached to said one panel at an attachment position on said first panel spaced from said one axis, a second spring blade attached to said second panel at an attachment position on said second panel spaced from said second axis, said first spring blade extending from said attachment position thereof through said opening in the first coupling means and said second spring blade extending from said attachment position thereof through said opening in the first coupling means, guide means carried by said first coupling member in straddling relation to said spring blades for defining a gap receiving and guiding said spring blades to move back and forth past said guide means as said panels swing about their respective first and second axes, and said spring blades being shaped between their attachments to the respective first and second panels and said guide means such that said spring blades are convergent as they enter said gap and engage each other at a contact point on the other side of said guide means from said panels when said panels have reached a partially inwardly swung position.

10. In a folding wall as defined in claim 9 including a third panel and hinge means pivotally connecting an edge of said third panel about a third axis to that edge of said first panel remote from said first axis, and a fourth panel and hinge means pivotally connecting an edge of said fourth panel about a fourth axis to that edge of said second panel remote from said second axis, second coupling means extending between the free edges of said third and fourth panels remote from said third and fourth axes respectively, hinge means pivotally connecting an edge of said second coupling means to a free edge of said third panel about a fifth axis and hinge means pivotally connecting an edge of said second coupling means to a free edge of said fourth panel about a sixth axis, all of said axes being parallel.

11. In a folding wall as defined in claim 10 wherein said second coupling means is provided with an opening aligned with the opening through said first coupling means and including a lever pivotally connected at one end to an inner face of said second coupling means and extending therefrom diagonally to terminate in an opposite end engaging said first side of said first coupling means, said lever having a pressing head secured thereto in alignment with said opening in the second coupling means.

12. In a folding wall as defined in claim 10 wherein said structure comprises a first discrete module, a second module identical to said first discrete module, a second coupling means of said second module being connected in opposing relation to said first coupling means of said first module and having an opening therethrough aligned with the opening through said first coupling means of said first discrete module, the ends of said first and second spring blades of said first discrete module passing through said opening in said second coupling means of said second module and terminating in spring blade ends within said second module, and a lever secured to said second coupling means of said second module and angling away therefrom toward the opposing side of the first coupling means of said second module to terminate in an end portion adapted to be engaged by said opposing side of the first coupling means of said second module and having an intermediate portion aligned with said spring blade ends so that in response to relative movement of said first and second coupling means of said second module towards each other, said lever will bear against said spring blade ends to force said spring blades towards the interior of said first discrete module.

13. In a folding wall as defined in claim 9 wherein engaging portions of said spring blades are provided with means for preventing relative slippage therebetween.

14. In a folding wall as defined in claim 10 wherein engaging portions of said spring blades are provided with means for preventing relative slippage therebetween.

15. In a folding wall as defined in claim 11 wherein engaging portions of said spring blades are provided with means for preventing relative slippage therebetween.

16. In a folding wall as defined in claim 12 wherein engaging portions of said spring blades are provided with means for preventing relative slippage therebetween.

17. In a folding wall, the structure comprising the combination of first and second panels, first coupling means extending between said panels and hinge means for pivotally connecting said panels to said first coupling means about first and second axes which are disposed in spaced parallelism, said first coupling means having an opening therethrough, a first spring blade connected at one end thereof to said first panel at a position spaced from said hinge means, a second spring blade connected at one end thereof to said second panel at a position spaced from said hinge means, and guide means carried by said first coupling means between said axes and within said opening for receiving and guiding said spring blades in convergent relation to a point of contact disposed beyond said guide means with respect to said panels.

18. In a folding wall as defined in claim 17 wherein the structure includes a third panel and hinge means pivotally connecting an edge of said third panel about a third axis to that edge of said first panel remote from said first axis, and a fourth panel and hinge means pivotally connecting an edge of said fourth panel about a fourth axis to that edge of said second panel remote from said second axis, second coupling means extending between said third and fourth panels remote from said third and fourth axes respectively, hinge means pivotally connecting said second coupling means to said third panel about a fifth axis and hinge means pivotally connecting said second coupling means to said fourth panel about a sixth axis, all of said axes being parallel.

19. In a folding wall as defined in claim 18 wherein said second coupling means is provided with an opening aligned with the opening through said first coupling means and the structure includes a lever pivotally connected at one end to an inner face of said second coupling means and extending therefrom diagonally to terminate in an opposite end engaging said first coupling means, said lever having a pressing head secured thereto in alignment with said opening in the second coupling means.

20. In a folding wall as defined in claim 19 wherein engaging portions of said spring blades are provided with means for preventing relative slippage therebetween.

21. In a folding wall as defined in claim 18 wherein said structure comprises a first discrete module, a second module identical to said first discrete module, a second coupling means of said second module being connected in opposing relation to said first coupling means of said first module and having an opening therethrough aligned with the opening through said first coupling means of said first discrete module, the ends of said first and second spring blades of said first discrete module passing through said opening in said second coupling means of said second module and terminating in spring blade ends within said second module, and a lever secured to the second coupling means of said second module and angling away therefrom toward the opposing side of the first coupling means of said second module to terminate in an end portion adapted to be engaged by said opposing side of the first coupling means of said second module and having an intermediate portion aligned with said spring blade ends so that in response to relative movement of said first and second coupling means of said second module towards each other, said lever will bear against said spring blade ends to force said spring blades towards the interior of said first discrete module.

* * * * *